US005639019A

United States Patent [19]

Mayled

[11] Patent Number: 5,639,019

[45] Date of Patent: Jun. 17, 1997

[54] FOLDING PAPERBOARD TRAY

[76] Inventor: Edward C. Mayled, 28 Groveland Crescent, Brampton, Ontario L6S 1L2, Canada

[21] Appl. No.: 607,978

[22] Filed: Feb. 29, 1996

[51] Int. Cl.[6] ..... B65D 5/22

[52] U.S. Cl. ..... 229/195; 229/190

[58] Field of Search ..... 229/190, 195, 229/197

[56] References Cited

U.S. PATENT DOCUMENTS

| | | | |
|---|---|---|---|
| 369,688 | 9/1887 | Buckingham | 229/195 |
| 2,642,218 | 6/1953 | Platt | 229/195 |
| 2,809,776 | 10/1957 | Barrington et al. | 229/195 |
| 2,833,459 | 5/1958 | Greene | 229/195 |
| 3,335,935 | 8/1967 | McCallum | 229/190 |
| 3,425,543 | 2/1969 | Harvey | 229/195 |
| 3,616,989 | 11/1971 | Martinek et al. | 229/195 |
| 4,133,430 | 1/1979 | Cravens | 229/190 |
| 4,573,633 | 3/1986 | Brian | 229/190 |
| 4,844,331 | 7/1989 | Oldfather | 229/190 |
| 5,402,932 | 4/1995 | Fadaie | 229/195 |

FOREIGN PATENT DOCUMENTS

| | | | |
|---|---|---|---|
| 2321431 | 3/1977 | France | 229/190 |
| 4314703 | 11/1994 | Germany | 229/190 |

*Primary Examiner*—Gary E. Elkins
*Attorney, Agent, or Firm*—Edward H. Oldham

[57] ABSTRACT

This invention relates to the improvement in an erectable tray which is formed from a single blank of material. Co-operating flaps and tabs at the corners of the erected sidewalls provide positive latching to complete the assembly of the tray. The blank may comprise, paperboard, corrugated cardboard, or a cor plast material.

10 Claims, 2 Drawing Sheets

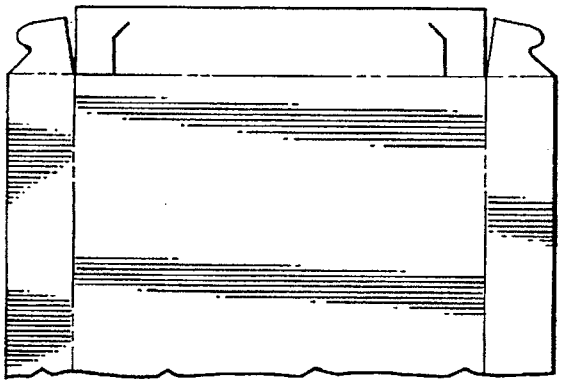
FIG. 1 (Prior Art)
FIG. 2.
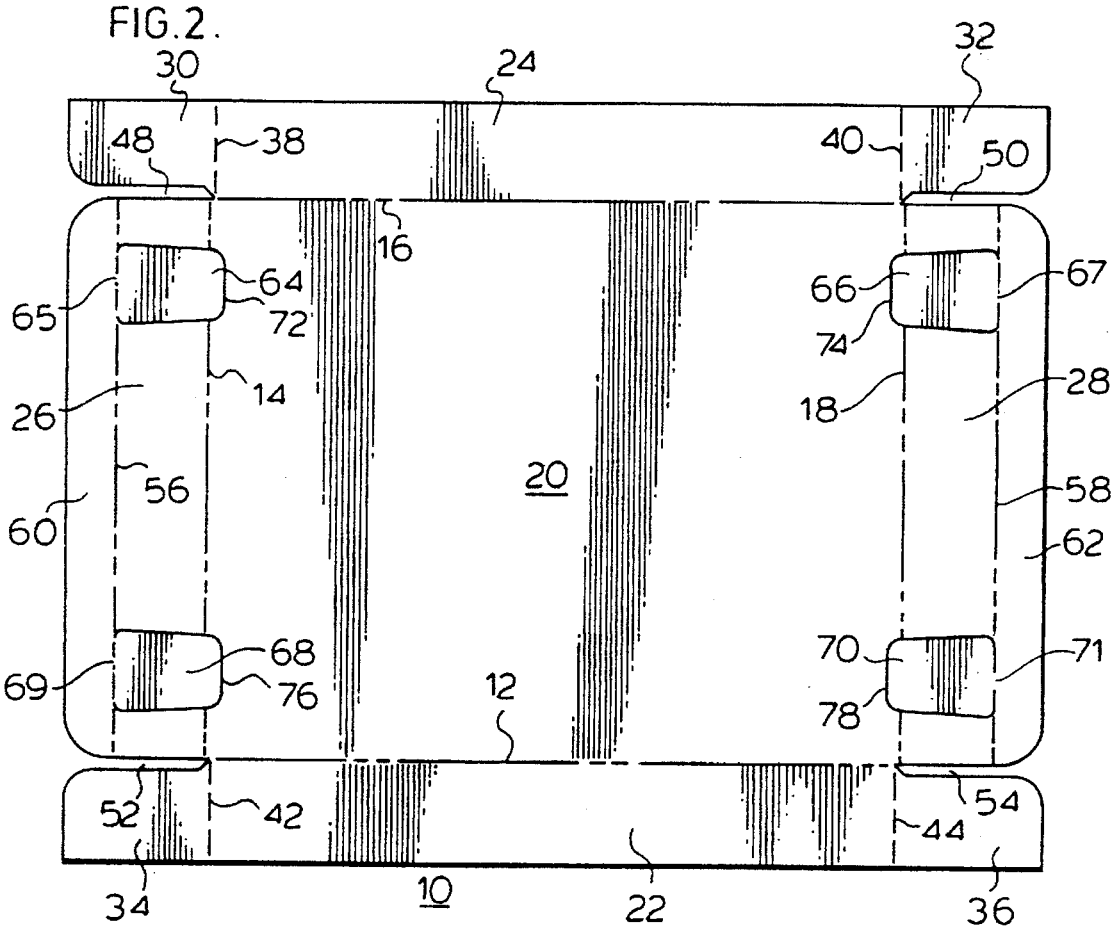

FOLDING PAPERBOARD TRAY

BACKGROUND OF THE INVENTION

This invention relates to an improvement in self locking trays and deals particularly with a tray formed of paperboard or the like which may be erected into a tray formation without requirement of staples, adhesives or other means for securing the corners of the tray together in a permanent fashion.

With the advent of the fast food era, the requirements for a semi-permanent tray have flourished. The requirements generally are that a tray be capable of assembly from a carton blank by a non-skilled worker instantly. Preferably, the carton must be assembled without the use of any pre-gluing or stapling to make the completed tray a functionable device.

More and more manufacturers are shipping products which are packaged in craftboard containers and bound together with a colourless plastic membrane on pallets. In most instances, groups of cartons are collated on trays on the pallets before being bound together.

As the retailer receives the pallets of products, usually the retailer will continue to use the collating tray to keep the products of the same type together on the display shelf in an attempt to provide product impact on the consumer.

When all the products displayed on the trays have been purchased, the retailer may provide the tray for the use of customers in removing merchandise from the premises on the tray. At times, it would be convenient for the retailer to be able to "knock down" the tray to its original flat shape for ease of storage until required in future. If, for instance, the tray was erected using a heat setting glue, it is almost impossible for a retailer to "knock down" such a carton and subsequently re-erect it at a later date.

Examples of prior art devices are Canadian Patents 1,137,050 issued Dec. 7, 1982, 1,041,968 issued Nov. 7, 1989, 890,780 issued Jan. 18, 1972, 885,859 issued Nov. 16, 1971 and 726,024 issued Jan. 18, 1966. Each of the above patents teaches a tray that may be constructed from a carton blank by suitable manipulation of the various parts of the carton blank.

Most of the prior art trays require a considerable amount of manual dexterity to assemble the final tray from the paperboard blank. Some of the blank designs require an inordinate amount of paperboard to construct the completed tray.

Prior art trays having narrow side walls have exhibited problems with panel stabilization because the sidewalls are too narrow to secure the slotted flaps. This tray overcomes this problem and will be quite rigid in its constructed form.

Difficulties with prior art designs can be found not only during the construction of the completed tray from the carton blank, where it maybe difficult if not impossible to be able to assemble the completed tray, but if time is a factor, it may be found that the prior art trays are only partially assembled so that the corner joints tend to bulge outwardly forming an awkward corner joint which may spontaneously disassemble delivering the contents to unintended locations.

SUMMARY OF THE INVENTION

It is to overcome such difficulties that the invention of this application was conceived. An absolute minimum of the basic paperboard is utilized to form the finished tray thus, the product tends to be ecologically acceptable.

Simultaneously, the tray uses a simple locking device that forms a sturdy corner connection to maintain the sides in an erect position and yet the locking device may be later unlocked to allow the tray to return to its original flat blank configuration so that it may be conveniently stored until it is required for future use.

The tray is preferably formed from a paperboard blank that is precut and prescored to enable ease of assembly. The corners are formed by means of an end flap extending from the end of each sidewall which folds into engagement with an adjacent end wall. A prestamped tang or tab in the end wall which tab has previously been folded upwardly to allow the sidewall end flap to be placed against the end wall is now folded downwardly to lock into an aperture in the base of the tray to lock the end flap in place. Preferably this operation would be performed simultaneously on the two corner joints at one end of the tray, so that the end wall would be locked in an upright position by constructing two corner joints simultaneously. The opposite end and sides are next assembled by constructing these walls using the same corner joint construction as described previously.

BRIEF DESCRIPTION OF THE DRAWINGS

A better understanding of the invention will be had when taken with the following description in which FIG. 1 is a plan view of one end of an erectable tray of the prior art, and FIG. 2 is a plan view of the preferred form of the blank used to fabricate the finished tray.

DESCRIPTION OF THE PREFERRED EMBODIMENTS

Figure 3:
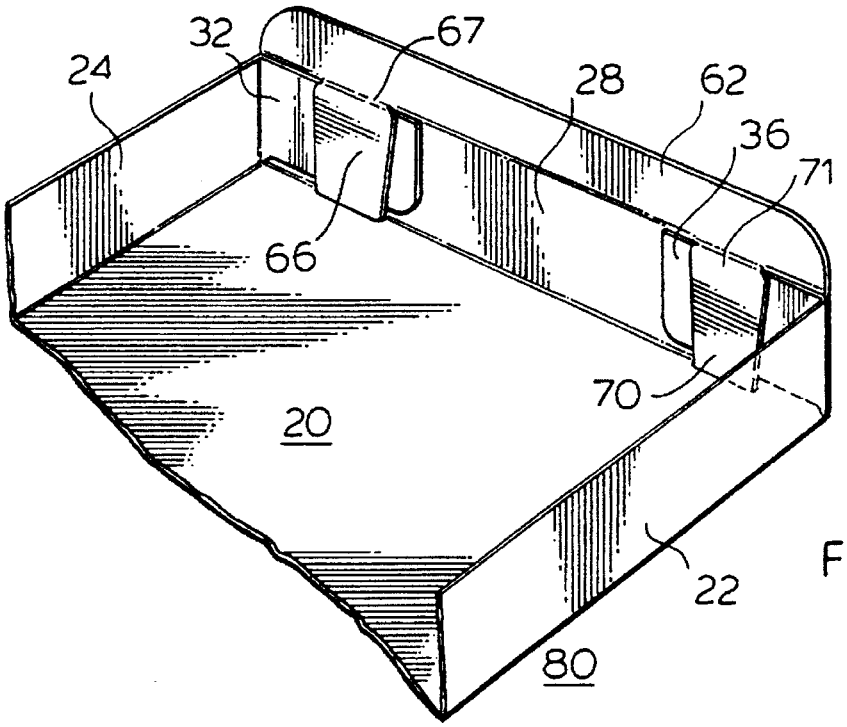
FIG. 3 is a partial perspective of the erected tray.

FIG. 1 is a plan view of a prior art tray which is erectable from a flat blank. The end panel is upwardly first, and then the side panels are bent upwardly, the tongues brought around the end of the sidewall panels, and are inserted into the provided slits in the endwall panels where the tongues may be locked into place.

The tray may be "knocked down" by releasing the tongues from the slits in the endwall panels, to produce a flat blank again.

The disadvantages of this tray are as follows:

1. The corner definition of the tray tends to suffer because of the resulting weakness of the end panel which is almost severed by the slit which accepts the tongue.
2. When stacks of blank cartons of the shape of the tray blank shown in FIG. 1 are in storage awaiting assembly, there is a tendency for damage to occur to the stacks of the tray blanks, and because of the corner profile, the tongue is very susceptible to damage, and once damaged, it is almost impossible to erect a usable tray from such a damaged blank.

FIG. 2 shows a tray blank 10 which is used for this invention. Blank 10 consists of a single piece of uniform material, preferably a relatively hard cardboard of thickness about 0.5 mm which may be coated with a paper which is adaptable for printing, or a heat resistant coating may be applied thereto.

Blank 10 is shown as being rectangular in shape and the thickness of the cardboard blank may be increased to provide sufficient structural rigidity for various applications.

Since the structure is symmetrical, only one corner joint will be described in detail although the description will include the entire blank.

Blank 10 (with the uncoated side uppermost) of a foldable material is cut, scored or creased as shown.

Four inner score lines 12, 14, 16, and 18 extending orthorgonally define the base floor 20 of the tray. Side panels 22 and 24 are formed by the score lines 12 and 16 on blank 10. End panels 26 and 28 are also formed in blank 10 by score lines 14 and 18. End flaps 30, 32, 34, and 36 are formed in side panels 22 and 24 by score lines 38, 40, 42, and 44 and cut outs 48, 50, 52, and 54 respectively. It will be noted that score lines 14 and 18 are not aligned with score lines 38, 42 and 40, 44, in that the score lines 14 and 18 are located closer to the extremities of the end panels 26 and 28 by a slight, but important distance.

The end panels 26 and 28 are provided with an additional score line each 56 and 58 respectively. These score lines may allow the flaps 60 and 62 to be folded at right angles to end panels 26 and 28 if desired at the end of the assembly operation.

Four tongues or tabs 64, 66, 68, and 70 are formed in end panels 26 and 28 by the provision of four somewhat U shaped slits. The tabs 64, 66, 68, and 70 are hingedly attached to the end walls at 65, 67, 69, and 71 and project inwardly.

The height of the hinge points 65, 67, 69, and 71 is important as these points are located above the adjacent score lines 14 and 18 by a distance slightly greater than the height of the adjacent side walls (or the width of the adjacent end flap). The location of the tabs is also important in that the tab must be located near the end of the end wall to engage the adjacent end flaps for erection of the tray. The width of the tabs should be sufficient to be able to physically restrain the end flaps in their erected position. The length of the tabs is critical.

Upon close examination tabs 64 and 68 are made to intersect score line 14 and extend lightly beyond line 14 as do tabs 66 and 70 with respect to score line 18. The reason for this will become apparent when the final tray is erected.

The assembly of the tray 80 is shown in FIG. 2 is as follows. Tongues or tabs 64, 66, 68, and 70 are pressed up to form a right angle with their respective end panels 26 and 28. The side panels 22 and 24 are next folded up at right angles to the floor 20 and end tabs 30, 32, 34, and 36 are folded inwardly at 90° to their respective side panels.

Tabs 64, 66, 68, and 70 have previously been bent upwardly at right angles to end panels 26 and 28, so that when end panels 26 and 28 are bent upwardly to provide the last pair of upright panels, the tabs 64, 66, 68, and 70 will clear the tops of previously bent end flaps 30, 32, 34, and 36.

At this time, both side panels 22 and 24 are upright with respect to floor 20 as are end panels 26 and 28.

Next tabs 64, 66, 68, and 70 are bent downwardly over end flaps 30, 32, 34, and 36 and pressed into slots provided in floor 20 by the slits shown as 72, 74, 76, and 78 at the base of the tabs.

It will be found because of the location of the score lines 14 and 18 and the location of the slit lines 72, 74, 76, and 78 that the tabs will positively lock the end flaps in a secured position against the end panels as shown in FIG. 3. The tabs protrude through apertures formed in the floor of the tray where the slits 72, 74, 76, and 78 were located.

Figure 4:
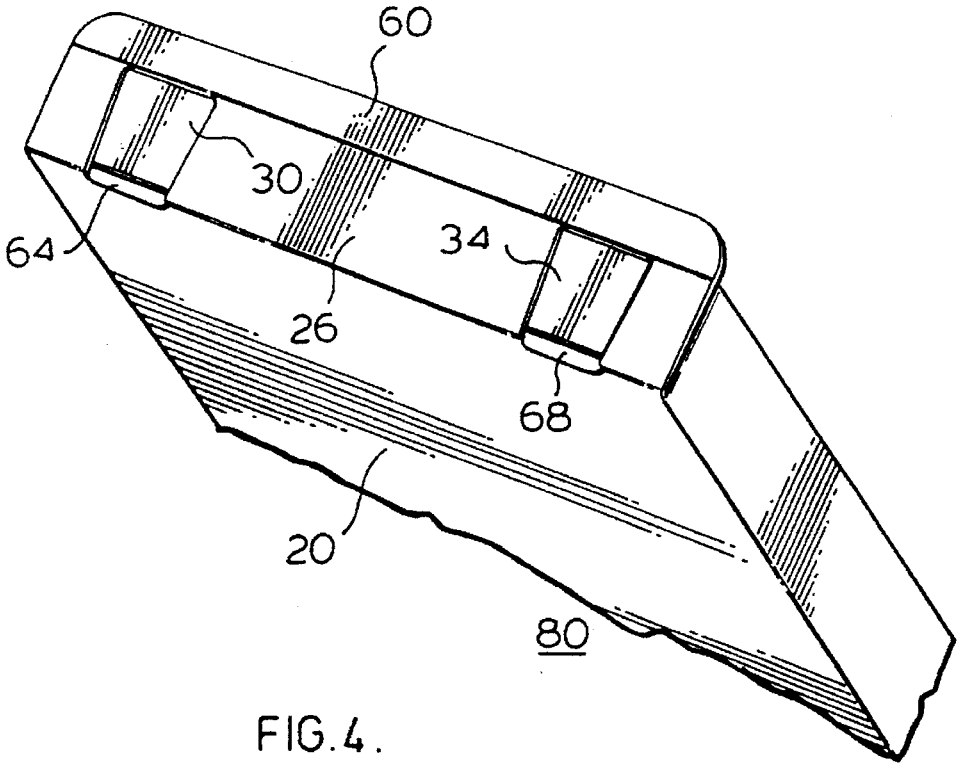
FIG. 4 is a partial perspective of one end of the erected tray of this invention.

FIG. 4 shows the end of tray 80 as viewed from the exterior. Flaps 64 and 68 protrude slightly below the floor 20 of the assembled tray 80. Flaps 30 and 34 are clearly visible through the apertures in end wall 26 formed by tabs 64 and 68.

Flap 60 may be bent over at right angles to end panel 26 to provide additional stiffness to the end panel if desired.

It will be found that once the tray 80 has been erected that the structure is very stable, and the corners are not prone to bulging or opening unintentionally during use. At the same time, if the tray 80 has not been damaged, it may be disassembled by pushing tabs 64 and 68 upwardly and inwardly to dislodge from the floor 20. The ends and sides of the tray may then be flattened to its basic planar form for ease of storage until further use of the tray is required.

The ruggedness of the erected structure is partially derived from the location of the tabs such as 64 and the location of score line 14. When the end panel 26 is folded up, the lower tip of tab 64 will protrude beyond the floor 20 to provide the required positive locking feature.

Changes to the design will be obvious to those skilled in the art such as having tabs or ears in side panels instead of the end panels, and of course, the end flaps such as 30 would be provided on the end panels to lock into position against the side panels. The shape of the end flaps on the side panels may be changed and this will necessitate a change in the location and shape of the locking tabs in the end walls.

Additional width of sidewall and endwall material may provide additional folds of material to provide an increase in the thickness of the sidewall and endwall panels for increased rigidity.

Although the word cardboard has been used throughout the description, it is to be understood that other materials may be substituted. A partial list, not all inclusive is, polyvinylchloride corrugated plastic or cardboard.

I claim:

1. A folded tray formed from a single blank of a suitable sheet material, comprising a central floor surrounded by upstanding sidewalls and endwalls, said sidewalls and endwalls being hingedly connected to said floor at the periphery thereof in oppositely disposed paired relationship, flap extensions hingedly attached at the ends of said sidewalls, and being folded inwardly to rest against the adjacent endwall, locking finger shaped tab means formed in each endwall for overlapping said folded flap extension of the adjacent sidewall, to maintain said endwalls and sidewalls in upstanding relationship.

2. A tray as claimed in claim 1 wherein the sheet material is a folding carton paperboard material, or a corrugated plastic material.

3. A foldable tray as claimed in claim 2 wherein said tab means comprises a finger shaped projection formed by a U shaped slit in the endwall.

4. A foldable tray as claimed in claim 3 wherein said tab means extends downwardly to engage the floor of said tray.

5. A foldable tray as claimed in claim 4 wherein said tab means is of sufficient length so that said tab means extends slightly below the floor of said tray.

6. A folded tray formed from a blank of suitable sheet material, said tray having a floor and opposing sidewalls and endwalls integrally joined to said floor, each of the sidewalls having a flap extending from the end of each sidewall, each of said endwalls having a pair of spaced apart downwardly extending locking tab members formed therein, each tab member being hingedly connected at the top of the endwall, said tab members being of such length as to extend from the top of each endwall to a point slightly beyond the floor of said tray, each sidewall flap folded inwardly against the inner surface of the adjacent endwall, and said tab members overlying said folded sidewall flap to secure the sidewall end flap against said endwall said tab members engaging the floor of said tray to lock said, folded sidewall end flap against each endwall.

7. A tray as claimed in claim 6 where the sheet material is a folding carton paperboard material, or a corrugated plastic material.

8. A rectangular carton blank having a first pair of scorelines extending across the length of said blank and spaced a first predetermined distance from the edge of said blank, a second pair of scorelines extending across the width of said blank and spaced a second predetermined distance from the edge of said blank, said scorelines forming a central rectangular panel surrounded by opposing sidewall and endwall panels each endwall panel having a pair of narrow slots cut therein at the end of each of said first pair of scorelines to define the ends of the endwall panels and form flaps at the ends of the sidewall panels each endwall panel having a U shaped tab formed therein at a location adjacent each narrow slot, each U shaped tab extending from a location near the outside edge of each end panel toward said central panel, so that said U shaped tab intersects and extends slightly beyond the adjacent scoreline joining the end panel to the central panel.

9. A carton blank as claimed in claim 8 wherein said second predetermined distance is greater than said first predetermined distance.

10. A foldable tray formed from a single blank of suitable paperboard which has been cut and scored so as to be erectable to form a tray, said blank having a central rectangular floor panel surrounded by sidewall panels, said panels being foldable to form upstanding sidewalls integrally joined to said floor panel, one pair of opposing endwalls having U shaped end flaps of predetermined shape extending from the ends thereof, the other pair of opposing sidewalls having tab means formed therein at pre-selected locations, each flap of each sidewall being foldable inwardly to lie against the adjacent upstanding endwall, said tab means being foldable to overlie said flap and lock into the floor panel in a predetermined manner to maintain the sidewalls in an upstanding position.

* * * * *